US007249969B2

(12) United States Patent
Paynter

(10) Patent No.: US 7,249,969 B2
(45) Date of Patent: Jul. 31, 2007

(54) CONNECTOR WITH CORRUGATED CABLE INTERFACE INSERT

(75) Inventor: Jeffrey D Paynter, Momence, IL (US)

(73) Assignee: Andrew Corporation, Westchester, IL (US)

( * ) Notice: Subject to any disclaimer, the term of this patent is extended or adjusted under 35 U.S.C. 154(b) by 0 days.

(21) Appl. No.: 11/383,489

(22) Filed: May 15, 2006

(65) Prior Publication Data

US 2006/0199431 A1 Sep. 7, 2006

(51) Int. Cl.
*H01R 9/05* (2006.01)

(52) U.S. Cl. ..... 439/578

(58) Field of Classification Search ..... 439/578, 439/583; 174/75 C
See application file for complete search history.

(56) References Cited

U.S. PATENT DOCUMENTS 5,137,470 A * 8/1992 Doles ..... 439/578
5,267,877 A 12/1993 Scannelli et al.
5,312,271 A * 5/1994 Matsumoto et al. ..... 439/578
5,561,900 A 10/1996 Hosler, Sr.
5,938,474 A * 8/1999 Nelson ..... 439/583
6,032,358 A 3/2000 Wild
6,471,545 B1 10/2002 Hosler, Sr.
6,676,446 B2 * 1/2004 Montena ..... 439/583

* cited by examiner

*Primary Examiner*—Phuong Dinh
(74) *Attorney, Agent, or Firm*—Babcock IP, PLLC

(57) ABSTRACT

An electrical connector for coaxial cable having a corrugated solid outer conductor. The connector formed with a body having a bore with a retaining shoulder. An insert with a plurality of segment(s) having inward projecting projections arranged to mesh with the corrugated solid outer conductor. The segment(s) joined by at least one hinge member(s); the insert bendable along the hinge member(s) to fit within the bore, abutting the retaining shoulder. An interface is attachable to a connector end of the body. The interface having an inward projecting outer conductor stop. By exchanging the insert, the connector may be used with a range of cables having different outer conductor corrugation configurations.

19 Claims, 7 Drawing Sheets

CONNECTOR WITH CORRUGATED CABLE INTERFACE INSERT

BACKGROUND OF THE INVENTION

1. Field of the Invention

The invention relates to an electrical connector. More particularly the invention relates to an electrical connector adaptable for use with coaxial cables having a variety of different outer conductor corrugations.

2. Description of Related Art

Connectors for corrugated outer conductor cable are used throughout the semi-flexible corrugated coaxial cable industry.

Solid outer conductor coaxial cables are available in two main groups of corrugation patterns, helical and annular. Typically, helical corrugation connector configurations are adapted to thread onto the corrugations, requiring precision cutting of a complementary internal threaded surface upon the connector body. Annular corrugation connector configurations often rely upon a clamping means that clamps the lead corrugation(s) at the cable end. These clamping means generally require precision thrust and clamping components, elaborate machining of spring finger element(s) and or additional cable end flaring operations to prepare the cable for connector installation.

Within each of these groups the corrugation depth, spacing, pitch and or number of corrugation leads varies between different cable models and or manufacturers. Prior connectors for use with solid outer conductor coaxial cable have therefore been designed for a specific outer conductor corrugation, requiring the design, manufacture and inventory of a wide range of different connectors, each dedicated to a specific cable configuration.

Advanced metal turning and or machining equipment is typically required to form the complex inner surfaces and or sub components of these connectors. These manufacturing operations comprise a significant portion of the overall manufacturing costs for the connectors.

U.S. Pat. No. 6,939,169, by Islam et al, issued Sep. 6, 2005 to Andrew Corporation, describes a connector for use with a coaxial cable having a helically corrugated solid outer conductor. The outer conductor is held by a body with inner threading adapted to mate with helical corrugations of the outer conductor, retaining the outer conductor for an axial compression connector mounting procedure. U.S. Pat. No. 6,939,169 is hereby incorporated by reference in the entirety.

As described herein above, a connector according to U.S. Pat. No. 6,939,169 must be manufactured for a specific outer conductor corrugation configuration. Also, because the design relies upon threading the helical corrugations of the outer conductor into the connector body, to retain the cable within the body during and after final axial compression, it is not usable with annular corrugated cable.

Competition within the cable and connector industry has increased the importance of minimizing installation time, required installation tools, and connector manufacturing/materials costs. Also, competition has focused attention upon ease of use, electrical interconnection quality and connector reliability.

Therefore, it is an object of the invention to provide an electrical connector and method of installation that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

As shown for example in FIGS. 1-9, the invention will be described in detail via an exemplary embodiment for use with 50 ohm helically corrugated solid outer conductor coaxial cable. The exemplary embodiment is configured for a standard 7/16 DIN connector interface. Alternatively, the connector interface may be a proprietary configuration or a standard interface, for example, Type F, SMA, DIN, Type N or BNC.

Figure 1:
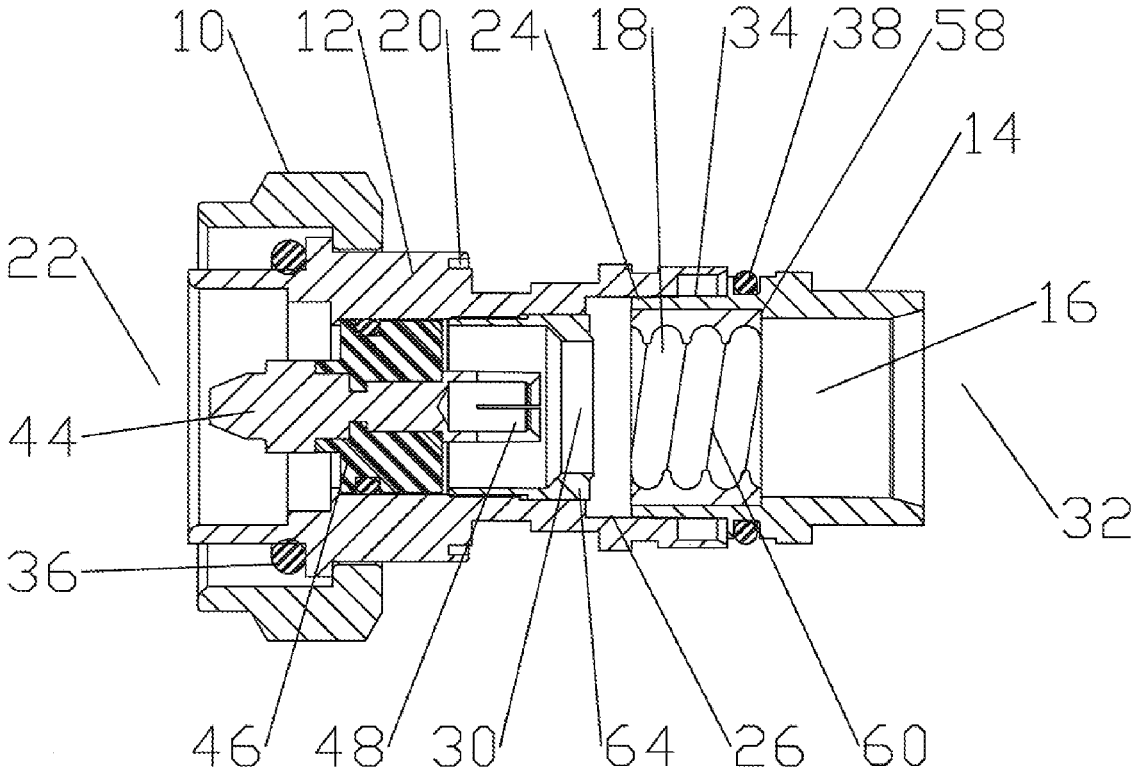
FIG. 1 is a cutaway side view of an exemplary embodiment of the invention, interface and body preliminarily coupled together before threaded helical corrugated cable insertion.
Figure 2:
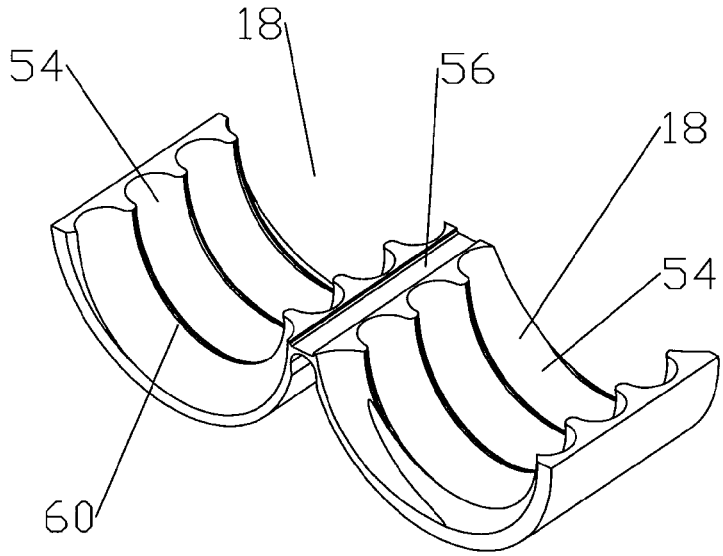
FIG. 2 is an isometric view of an insert for a helical corrugated outer conductor, in a preform configuration.
Figure 3:
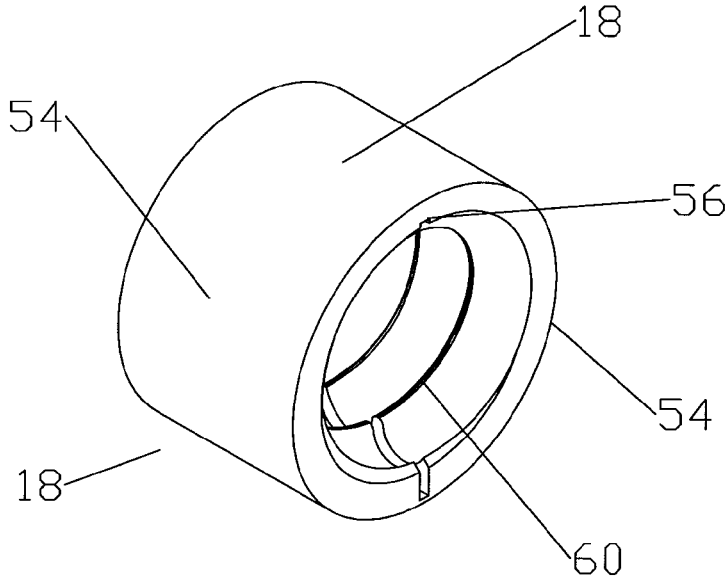
FIG. 3 is an isometric view of an insert for a helical corrugated couter conductor, in a folded configuration.
Figure 4:
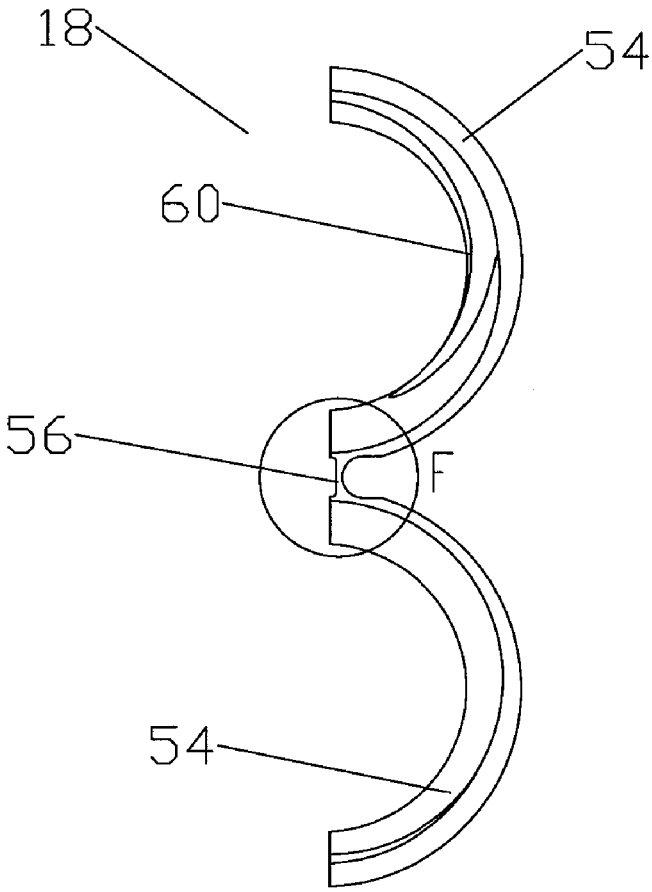
FIG. 4 is a side view of the insert of FIG. 2.
Figure 5:
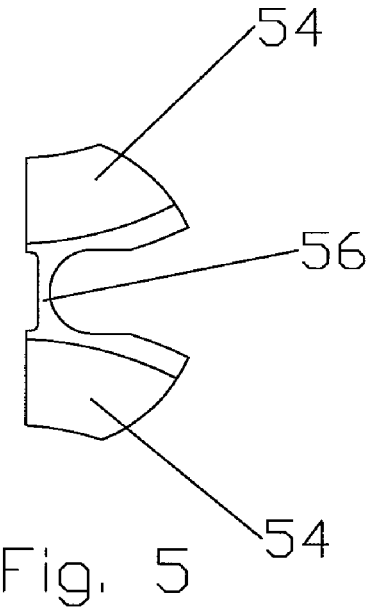
FIG. 5 is a close up view of area F of FIG. 3.
Figure 6:
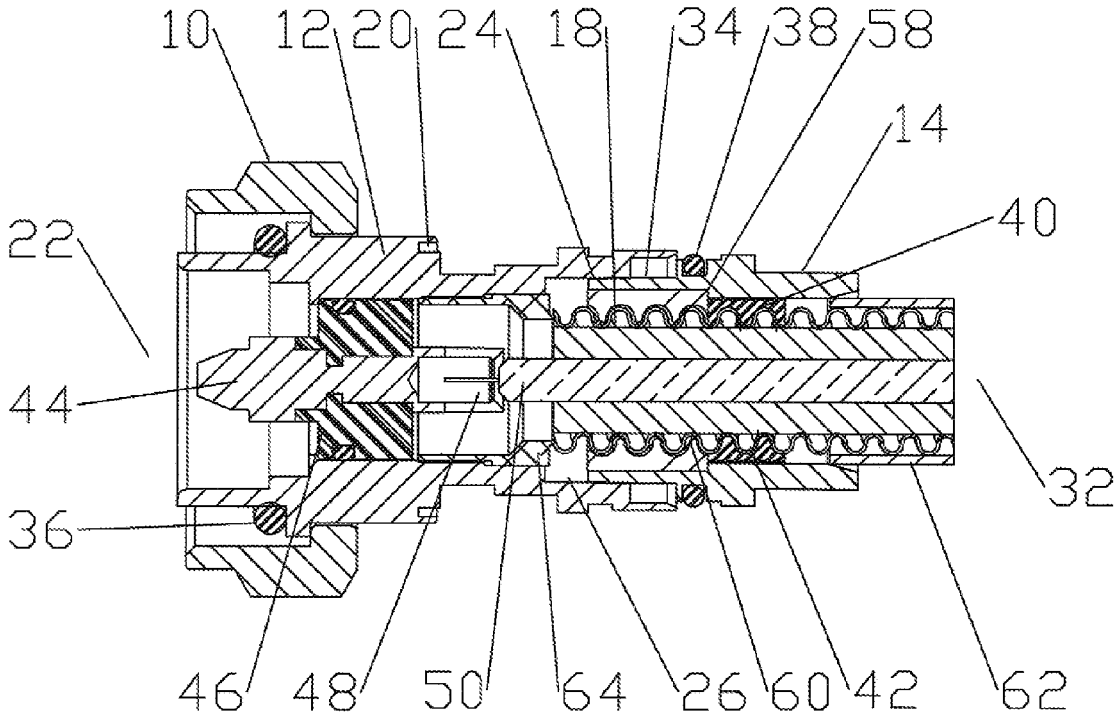
FIG. 6 is a cutaway side view of an exemplary embodiment of the invention, showing a cable ready for final axial compression.

As shown in FIG. 1, the connector has a coupling nut 10 upon an interface 12 that is coupled to a body 14 having a body bore 16 fitted with an insert 18. The coupling nut 10 may be retained upon the interface 12, for example, by deforming an outer edge of a cable end 32 facing retention groove 20 before or during an axial compression connector mounting step.

The exemplary embodiment is configured for interconnection in an interference fit via application of axial compression along a longitudinal axis of the connector. At the connector end 22 of the body 14, an interface mounting guide surface 24 has an outer diameter adapted to initially receive and align a body coupling surface 26 of the interface bore 30 that is open to the cable end 32 of the interface 12.

An interface mounting surface 34, adjacent to the interface mounting guide surface 24, has a slightly larger diameter adapted to retain the cable end 32 of the interface 12 in a final interference fit along the complementary body coupling surface 26 of the body 14.

A plurality of compressible and or deformable sealing gaskets, for example rubber or silicon o-rings, may be located around and within the connector to environmentally seal between adjacent surfaces. In the exemplary embodiment, a first gasket 36 is positioned on the interface 12 in an outer shoulder facing the connecter end 22 for sealing against a mating connector (not shown). A second gasket 38 is located between the interface 12 and the body 14, seated upon the body 14, to seal the connection between the interface 12 and the body 14. A third gasket 40 may be placed upon the outer conductor for sealing against the body 14. If the connector is to be installed in a dry environment, one or more of the gaskets may be omitted.

A contact pin 44 is held coaxially within the interface by an insulator 46. Spring finger(s) 48 may be formed in the cable end of the center contact pin, biased radially inward to grasp a center conductor 50 of the cable 52.

As shown for example in FIGS. 2-5, the insert 18 is preferably formed as two or more segment(s) 54 joined by one or more hinge member(s) 56. The segment(s) 54 are bendable towards each other along the hinge member(s) 56 to allow the insert 18 to be fitted into the body bore 16 until the insert 18 abuts a retaining shoulder 58. A keying function to prevent rotation of the insert with respect to the body may be implemented by adding an inward projecting key, spline or the like to the body bore 16, for example, that fits into a keyway of the body bore 16 such as a slot. Outer conductor projections 60 are formed in the segment(s) 54 projecting radially inward. The outer conductor projections(s) 60 are adapted to mesh with the corrugations formed in the outer conductor 42 of the desired cable 52.

The outer conductor projection(s) 60 may be formed as a mating surface for the desired corrugations dedicated to a specific cable helical or annular corrugation pattern. Alternatively, the outer conductor projection(s) 60 may be formed as a plurality of staggered pins or the like spaced to mate with a specific annular as well as a related helical corrugation. Mating retaining portion(s), such as a snap, clip, tab or hook into hole closure may also be applied to opposing ends of the insert 18 to retain the insert 18 in a cylindrical form prior to final assembly.

One skilled in the art will appreciate that, before bending to conform to the outer conductor 42 and or body bore 16, the insert 18 may be designed with a preform shape without overhanging portions along a single plane. Therefore, a simplified arrangement of two part dies or molds may be applied to form the insert 18, enabling manufacture via using cost efficient manufacturing methods such as stamping, injection molding or casting.

The insert 18 may be injection molded from conductive metal material, for example by thixotropic magnesium alloy metal injection molding. In this process, a powdered magnesium alloy is heated until it reaches a thixotropic state. The flowable material may then be molded similar to conventional polymer injection molding. The magnesium alloys used in thixotropic metal molding have desirable conductivity and rigidity characteristics and also have the benefit of being light in weight.

Depending upon the characteristics of the specific polymer, plastic, metal or metal alloy selected for forming the insert, the width and thickness of the hinge member(s) 56 is dimensioned to allow easy bending of the segment(s) 54 towards one another, without fracturing the hinge member(s) 56 or deforming the segment(s) 54, either around the outer conductor 42 circumference or into a generally cylindrical form for insertion into the body bore 16.

Where the insert 18 outer conductor projections 60 are helical, the connector may be pre-configured for use by assembling the components and applying limited axial compression to partially seat the interference fit surfaces together as shown in FIG. 1. This provides a user with a single assembly to handle, and removes the opportunity to misplace and or damage the individual connector components.

To install a helical corrugated outer conductor 42 embodiment of the connector upon a coaxial cable, the user prepares the cable 52 end by stripping back portions of the outer conductor 42 and outer sheath 62, if present, to expose the center and outer conductors 50, 42. The cable 8 is then inserted into the cable end 32 of the body bore 16, and the connector rotated to thread the outer conductor projection(s) 60 of the insert 18 upon the helical corrugations of the outer conductor 42. The threading is continued until a leading edge of the outer conductor 42 is bottomed against an inward projecting outer conductor stop 64 of the interface 12, as shown for example in FIG. 6. The outer conductor stop 64 may be formed as a shoulder of the interface bore 30 or as a separate component, for example, press fit into the interface bore 30.

Figure 7:
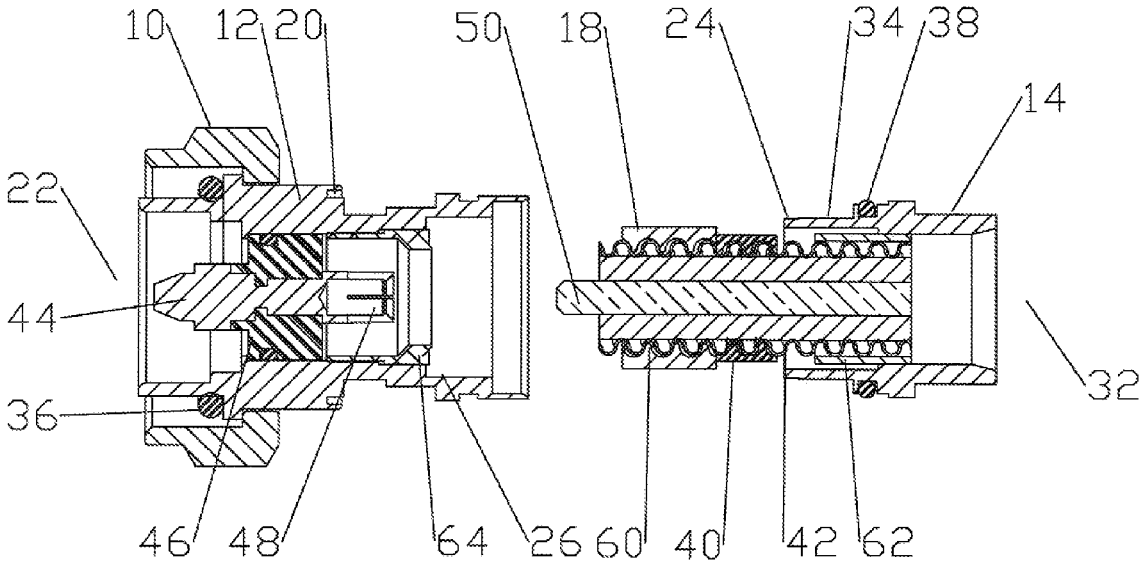
FIG. 7 is a cutaway side view of an exemplary embodiment of the invention, the insert applied to the cable before joining the interface and the body.
Figure 8:
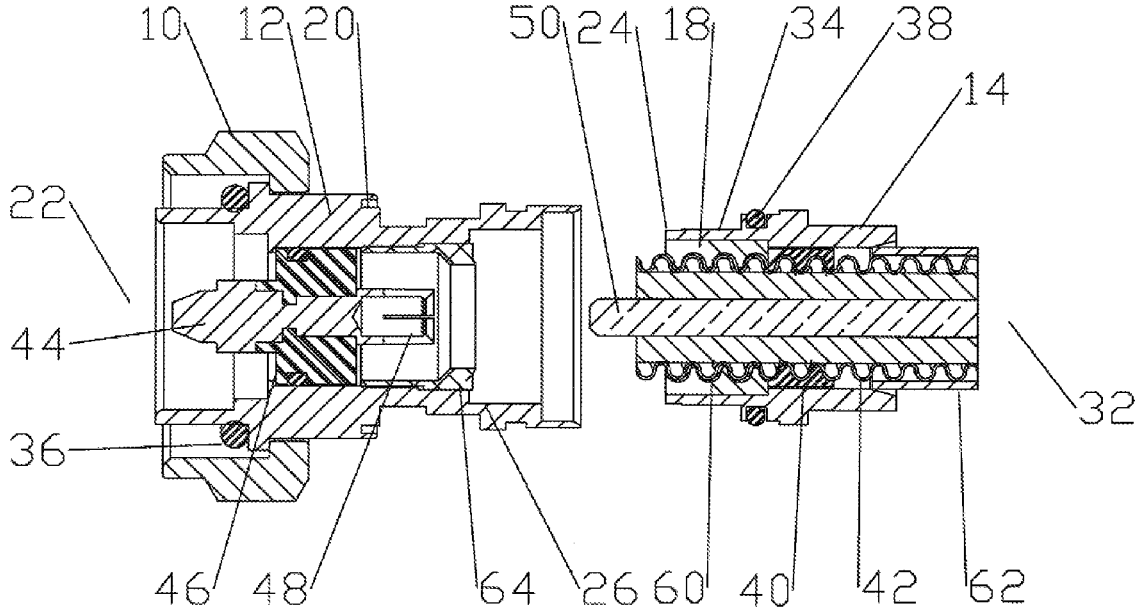
FIG. 8 is a cutaway side view of an exemplary embodiment of the invention, the insert mounted upon the cable and seated against the shoulder before joining the interface to the body.

In an annular corrugated outer conductor 42 embodiment, the annular corrugations cannot be threaded into the outer conductor 42. Also, in some configurations the insert 18 may not easily allow threading of a helical corrugated outer conductor 42 cable 52 into the insert 18 while the insert 18 is seated within the body 14. In these cases, the cable 52 is stripped back as described herein above and inserted through the body 14 before the interface 12 and insert 18 is applied. The insert 18 is folded along the hinge member(s) 56 around the outer conductor 42 projecting beyond the connector end 22 of the insert 18 to mate the outer conductor projections of the insert with the annular corrugations of the outer conductor 42, for example as shown in FIG. 7. A portion of the cable 52 end extends beyond the insert 18. This is the portion that will extend to contact the outer conductor stop 64 of the interface 12, before final axial compression. With the insert 18 closely mated around the outer conductor 42, the outer conductor 42 is retracted to pull the insert 18 within the body 14 until it is seated against the retaining shoulder 58, for example as shown in FIG. 8. The body 14 and the interface 12 are then preliminarily mated together by fitting the interface mounting guide surface 24 and the body coupling surface 26 of the interface 12, again as shown for example in FIG. 6.

Axial compression is applied to complete the interconnection of the body 14 and the interface 12. Depending upon the cable dimensions and deformation characteristics of the outer conductor 42 material, the axial compression may be applied, for example, using a suitable hydraulic press and or a common hand tool. During axial compression, the interference fit surfaces between the body and the interface are fully seated up to their respective stop points. Also, the relative movement compresses the second gasket 38 between the body 14 and the interface 12 and the third gasket 40 between the cable end of the body 14 and the outer conductor 42 and or outer sheath 62, environmentally sealing the connector.

The leading edge of the outer conductor 42 of the cable 52, already bottomed against the outer conductor stop, is further driven against the outer conductor stop 64 by the axial compression and deformed against it due to the engagement between the outer conductor 42 and the outer conductor projection(s) 60 of the insert 18 which is retained within the body bore 16 by the retaining shoulder 58 as the body 14 is moved towards the interface 12 by the axial compression.

Figure 9:
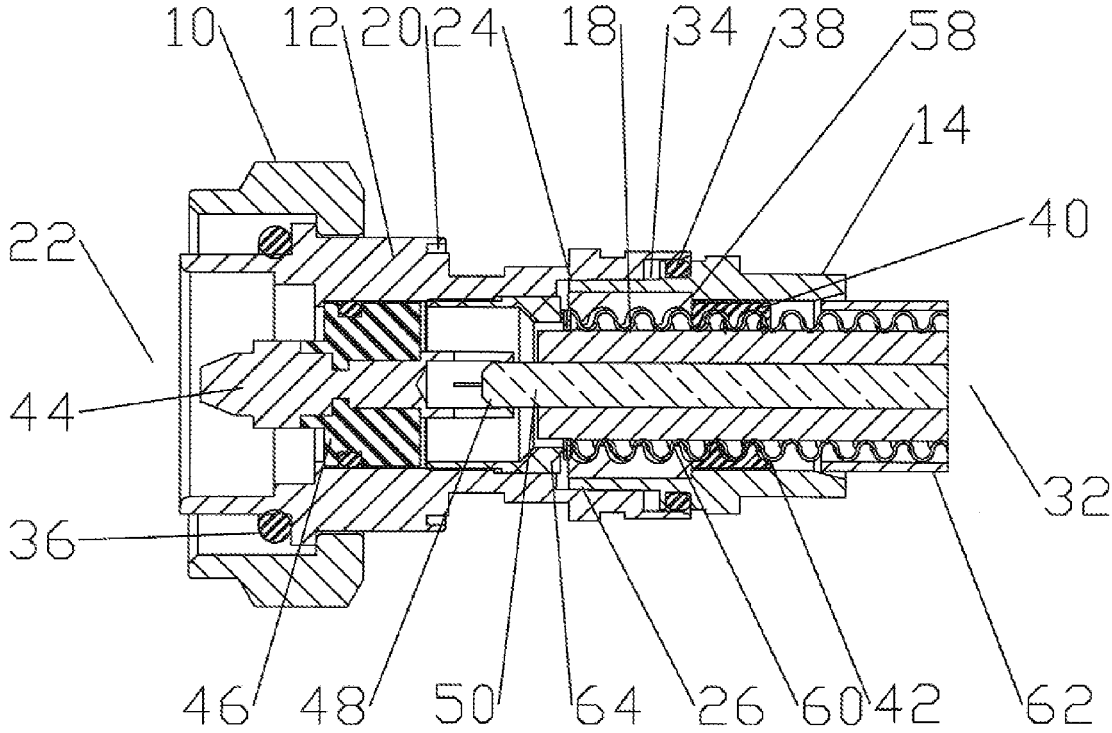
FIG. 9 is a cutaway side view of an exemplary embodiment of the invention, mounted upon a coaxial cable, after final axial compression.

As shown in FIG. 9, the deformation of the leading edge of the outer conductor 42 into the outer conductor stop 64 creates a secure and reliable electrical interconnection against the outer conductor stop 64, around the full diameter of the outer conductor 42 leading edge. Further, in helical corrugation embodiments, the deformation disrupts the helical corrugations forward of the outer conductor projection(s) 60 of the insert 18. Thereby, the connector is fixed in place upon the cable 52, prevented from unthreading along the helical corrugations.

In further alternative embodiments, the connector may be configured for assembly by threading together rather than application of axial compression. Threads applied between the interface 12 and body 14 allow rotation of the interface 12 with respect to the body 14 to form a secure electrical and mechanical interconnection as the leading edge of the outer conductor 42 initially seats and then deforms against the outer conductor stop 64.

The invention provides a simplified and cost effective environmentally sealed connector with improved electrical characteristics. Depending upon the material characteristics and dimensions of the particular cable used, the connector may be quickly and securely attached using only simple hand tools.

Through application of a range of different inserts 18, a single connector according to the invention may be used with any of a number of different coaxial cables having any desired outer conductor corrugation. Because the inserts 18 may be cost efficiently formed via simplified manufacturing methods such as stamping, casting and or injection molding, the prior need for additional clamping element(s) and or internal thread/corrugation machining operations upon the body bore 16 have been eliminated.

Table of Parts

| | |
|---|---|
| 10 | coupling nut |
| 12 | interface |
| 14 | body |
| 16 | body bore |
| 18 | insert |
| 20 | retention groove |
| 22 | connector end |
| 24 | interface mounting guide surface |
| 26 | body coupling surface |
| 30 | interface bore |
| 32 | cable end |
| 34 | interface mounting surface |
| 36 | first gasket |
| 38 | second gasket |
| 40 | third gasket |
| 42 | outer conductor |
| 44 | contact pin |
| 46 | insulator |
| 48 | spring finger |
| 50 | center conductor |
| 52 | cable |
| 54 | segment |
| 56 | hinge member |
| 58 | retaining shoulder |
| 60 | outer conductor projection |
| 62 | outer sheath |
| 64 | outer conductor stop |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

The invention claimed is:

1. An electrical connector for coaxial cable having a corrugated solid outer conductor, comprising:

a body having a body bore with a retaining shoulder;

an insert within the body bore, abutting the retaining shoulder;

the insert having inward projecting outer conductor projections arranged to mesh with the corrugated solid outer conductor;

an interface dimensioned to couple with a connector end of the body in an interference fit via application of axial compression;

the interface having an inward projecting outer conductor stop.

2. The connector of claim 1, wherein the outer conductor projections are formed upon a plurality of segment(s); the segment(s) joined by at least one hinge member(s), the insert foldable along the at least one hinge member(s) for converting the insert from a preform configuration having a single plane without overhangs into a generally cylindrical configuration for insertion within the bore.

3. The connector of claim 1, wherein the body has an interface mounting guide surface at an interface end and an interface mounting surface adjacent to the interface mounting guide surface; and the interface has an interface bore with a body coupling surface;

the interference fit between the body and the interface formed between the interface mounting surface and the body coupling surface.

4. The connector of claim 3, wherein the inward projecting outer conductor stop is inserted within the interface bore.

5. The connector of claim 1, wherein the outer conductor projections are protrusions positioned to mesh with the corrugated solid outer conductor having an annular or a helical corrugation.

6. The connector of claim 1, further including a gasket located between the outer conductor and the body, at a cable end of the insert.

7. The connector of claim 1, further including an insulator in the interface bore; and a contact pin supported by the insulator coaxial within the interface bore.

8. An electrical connector for coaxial cable having a corrugated solid outer conductor, comprising:

a body having a body bore with a retaining shoulder;

an insert with a plurality of segment(s) positioned in an interface end of the body bore;

the insert having inward projecting outer conductor projections positioned to mesh with the corrugated solid outer conductor; the segment(s) joined by at least one hinge member(s); the insert foldable along the hinge member(s) to fit within the bore, abutting the retaining shoulder;

an interface attachable to a connector end of the body;

the interface having an inward projecting outer conductor stop.

9. The connector of claim 8, wherein the outer conductor projections of the insert are positioned to mesh with the corrugated solid outer conductor having helical corrugations.

10. The connector of claim 8, wherein the outer conductor projections of the insert are positioned to mesh with the corrugated solid outer conductor having annular corrugations.

11. The connector of claim 8, wherein the outer conductor projections of the insert are positioned to mesh with the corrugated solid outer conductor having helical corrugations or annular corrugations.

12. The connector of claim 8, wherein the insert has two segments and one hinge member.

13. The connector of claim 8, wherein the interface is attachable to the connector end of the body via an interference fit.

14. The connector of claim 8, wherein the interface is attachable to the connector end of the body via threads.

15. The connector of claim 8, wherein the inward projecting outer conductor stop is inserted into a cable end of an interface bore.

16. The connector of claim 8, wherein the inward projecting outer conductor stop is formed integral with a cable end of the an interface bore.

17. The connector of claim 8, wherein the insert is rotationally interlocked with the body.

18. The connector of claim 8, wherein the insert has no overhanging projections in a single plane, prior to being folded.

19. An electrical connector for coaxial cable having a corrugated solid outer conductor, comprising:

a body having a body bore with a retaining shoulder;

an interface mounting guide surface at an interface end of the body and an interface mounting surface adjacent to the interface mounting guide surface;

an insert with a plurality of segment(s) positioned in an interface end of the body bore;

the insert having inward projecting outer conductor projections positioned to mesh with the corrugated solid outer conductor; the segment(s) joined by at least one hinge member(s); the insert foldable along the hinge member(s) to fit within the bore, abutting the retaining shoulder;

an interface with an interface bore having a body coupling surface;

an interference fit between the body and the interface formed between the interface mounting surface and the body coupling surface via application of axial compression;

the interface having an inward projecting outer conductor stop.

* * * * *